United States Patent [19]

Kemeny

[11] Patent Number: 4,727,695

[45] Date of Patent: Mar. 1, 1988

[54] BUILDING STRUCTURE SHOCK ISOLATION SYSTEM

[76] Inventor: Zoltan A. Kemeny, 7625 N. 10th St., Phoenix, Ariz. 85020

[21] Appl. No.: 888,963

[22] Filed: Jul. 24, 1986

[51] Int. Cl.[4] ..... E04H 9/02

[52] U.S. Cl. ..... 52/167; 52/573; 52/393; 14/16.1; 248/634; 384/36

[58] Field of Search ..... 52/167, 393, 573, 403; 188/378, 379; 248/632, 634, 636, 638; 267/63 A, 140.4, 140.5, 141.3, 153; 14/16.1, 16.5; 384/36

[56] References Cited

U.S. PATENT DOCUMENTS

| | | | |
|---|---|---|---|
| 2,373,798 | 3/1943 | Williams . | |
| 3,797,183 | 3/1974 | Kobayashi et al. | 52/167 |
| 3,921,240 | 11/1975 | Fyfe | 14/16.1 |
| 3,986,222 | 10/1976 | Miyazaki et al. | 14/16.1 |
| 4,002,315 | 1/1977 | Van Goubergen | 248/24 |
| 4,121,393 | 10/1978 | Renault et al. | 52/167 |
| 4,187,573 | 2/1980 | Fyfe et al. | 14/16.1 |
| 4,238,137 | 12/1980 | Furchak et al. | 384/36 |
| 4,333,280 | 6/1982 | Morton | 52/167 |
| 4,338,758 | 7/1982 | Hagbjer | 52/742 |
| 4,363,149 | 12/1982 | Kondo et al. | 14/16.1 |
| 4,452,019 | 6/1984 | Ikuo et al. | 52/167 |
| 4,615,157 | 10/1986 | Murray | 52/167 |

FOREIGN PATENT DOCUMENTS

| | | | |
|---|---|---|---|
| 815209 | 6/1969 | Canada | 14/16.1 |
| 2063699 | 7/1972 | Fed. Rep. of Germany | 14/16.1 |
| 904850 | 11/1945 | France | 248/632 |
| 701311 | 2/1966 | Italy | 52/167 |
| 468525 | 3/1969 | Switzerland | 14/16.1 |
| 362470 | 11/1931 | United Kingdom | 248/632 |
| 554387 | 10/1974 | U.S.S.R. | 52/167 |
| 727763 | 4/1980 | U.S.S.R. | 52/167 |
| 804798 | 2/1981 | U.S.S.R. | 52/167 |
| 848797 | 7/1981 | U.S.S.R. | 267/153 |

*Primary Examiner*—John E. Murtagh
*Assistant Examiner*—Andrew Joseph Rudy
*Attorney, Agent, or Firm*—Cahill, Sutton & Thomas

[57] ABSTRACT

A building structure shock isolation system is disclosed incorporating aseismic bearings for positioning between major structural components of the building and between such components and the building foundation. The aseismic bearings include opposing plates having interlocking cross-sectional configurations with respect to each other to form a keyed shear and uplift proof element positioned between the foundation and the structural elements. An elastomeric layer is placed between the plates to provide shock and vibration isolation and energy dissipation.

4 Claims, 16 Drawing Figures

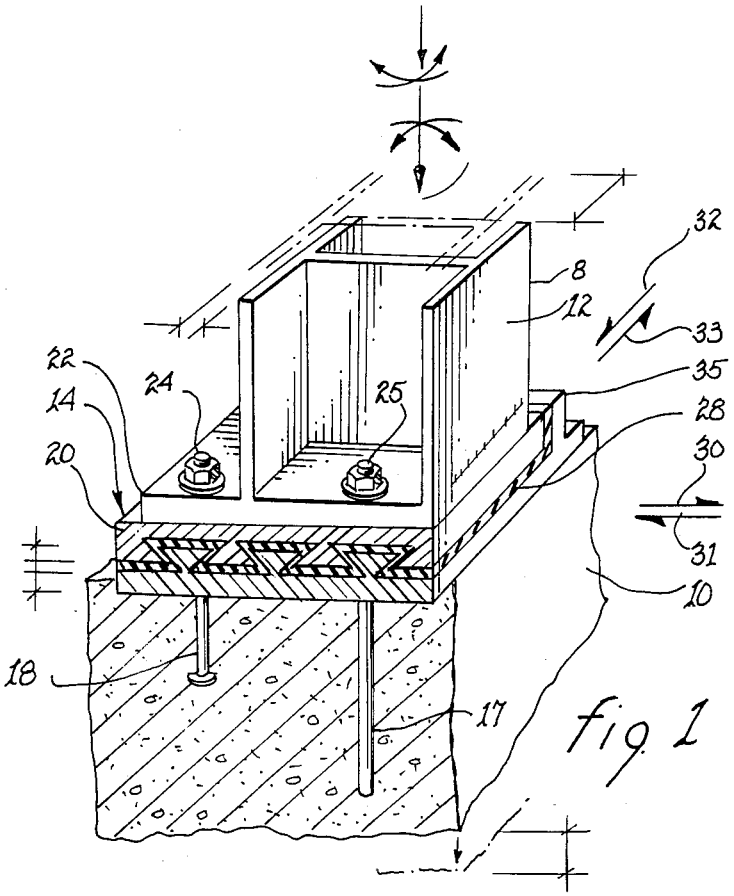
fig. 1
SYMMETRICAL SERIES
(Ss)
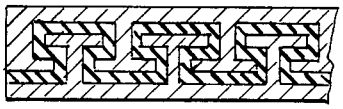
fig. 2
ASSYMETRICAL SERIES
(As)
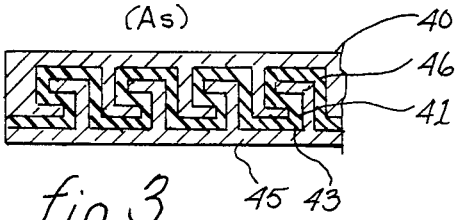
fig. 3
fig. 4
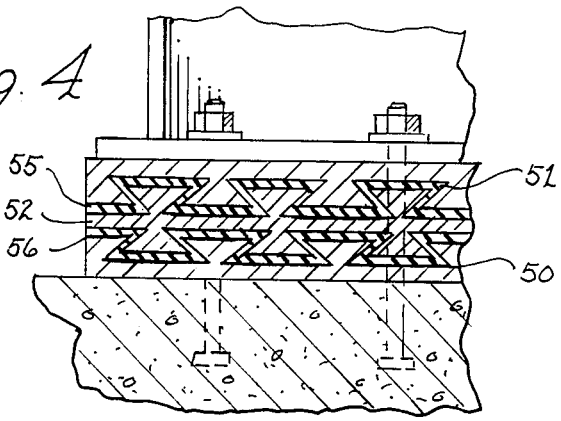
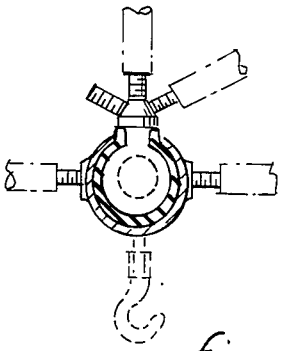
fig. 10

BUILDING STRUCTURE SHOCK ISOLATION SYSTEM

FIELD OF THE INVENTION

The present invention relates to shock isolation and energy dissipation systems for building structures, and more specifically to the use of vibration isolating and energy dissipating materials such as elastomers and the like in building structures to absorb externally originating shock loading.

BACKGROUND

The importance of protecting buildings from vibratory or impact dynamic motions resulting from seismic disturbances, wind vortices, reciprocating or unbalanced machines, or external impact such as fragment scattering has become increasingly important. The importance of seismic insulation particularly in the construction of nuclear power plants has become a matter of substantial investigation. For example, the isolation of building structures from seimsic motion has been achieved by the prior art in some instances through the utilization of an elastomer such as rubber placed between plates (usually of steel) to form aseismic bearings. These bearings are placed beneath the building structure between the structure and its foundation. The seismic subsoil motion is thus isolated by the elastomers to greatly reduce the acceleration imparted to the building structure thus eliminating or minimizing damage and inhibiting the transmission of undesireable stresses and strains.

Typically, these prior art bearings are formed having multiple plates with intermediate elastomeric material thus forming a multi-layered structure. While such structures may be effective in the isolation of certain seismic disturbances, there nevertheless exists the necessity to counteract rocking motions by anchoring the building structure to the foundation. Such anchoring is required in the prior art apart from the aseismic bearing to prevent shear forces and/or uplift forces from disturbing the structural integrity of the building.

OBJECTS OF THE INVENTION

It is therefore an object of the present invention to provide an improved vibration and shock isolation system for use in building structures.

It is another object of the present invention to provide a vibration and shock isolation system that is slide-away and separation proof while maintaining the advantages of simplicity and effectiveness of elastomeric isolation.

It is still another object of the present invention to provide a vibration and shock isolation system incorporating keyed plates separated by an elastomeric layer of material to provide uplift and shear resistance to maintain building integrity.

It is still another object of the present invention to provide a vibration and shock isolation system for utilization in a building structure incorporating shock and vibration isolation elements at strategic junctions of major structural components such as structural connections.

It is still another object of the present invention to provide energy dissipation elements at strategic junctions of major structural components as well as providing shock and vibration isolation at those junctions.

These and other objects of the present invention will become apparent to those skilled in the art as the description proceeds.

SUMMARY OF THE INVENTION

Briefly, in accordance with one embodiment chosen for illustration, a building structure incorporating a foundation designed to support major structural elements is provided with a plurality of aseismic bearings each positioned at a junction of the structural element and foundation. Each of the aseismic bearings incorporates a donor plate secured to the foundation and a receptor plate secured to the major structural element. A layer of elastomeric material is positioned between and in contact with the donor and receptor plates to maintain the plates separated. The plates are formed having interlocking cross-sectional configurations with respect to each other to form a keyed layered structure with the keyed donor and receptor plates separated by the elastomeric material to provide a shear and uplift proof intermediate element between the foundation and the major structural component.

BRIEF DESCRIPTION OF THE DRAWING

The present invention may more readily be described by reference to the accompanying drawings in which:

FIG. 1 is an isometric view, partly in section, showing an aseismic bearing constructed in accordance with the teachings of the present invention positioned between a building foundation and a major structural component.

FIG. 2 is a cross-sectional view of an alternative configuration of the aseismic bearing shown in FIG. 1.

FIG. 3 is a cross-sectional view showing another alternative configuration of an aseismic bearing constructed in accordance with the teachings of the present invention.

FIG. 4 is a cross-sectional view of an alternative configuration of an aseismic bearing constructed in accordance with the teachings of the present invention showing the use of an interceptor plate.

FIG. 10 is a representation of the concept of the present invention embodied in a space truss.

DETAILED DESCRIPTION OF THE PREFERRED EMBODIMENT

Figure 5:
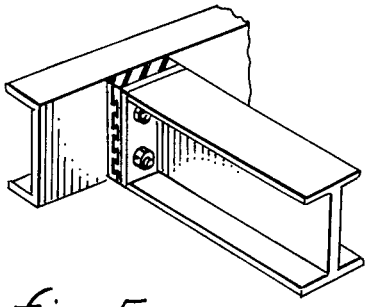
FIG. 5 is an isometric view showing a vibration and shock isolation element positioned between elements of the superstructure of a building.

Referring now to FIG. 1, a foundation 10 is shown for supporting a major structural element of a building, in this particular instance a column 12. A vibration and shock isolation bearing system 14 is provided including a donor plate 16 secured to the foundation 10. The donor plate 16 may be secured in any of several fashions including anchoring bar 17 that is welded or otherwise secured to the bottom (not shown) of the donor plate 16 or an anchoring bolt or headed anchor stud 18 similarly attached to the donor plate 16. It may be noted that at this juncture, the donor plate 16 is firmly and permanently secured to the foundation 10 and receives substantially all stresses transmitted by the foundation 10.

A receptor plate 20 is secured to the column 12 in any convenient manner such as by welding a base plate 22 to the bottom of the column 12 to receive threaded bolts such as those shown at 24 and 25 and their corresponding nuts. The bolts 24 and 25 are welded or otherwise secured to the receptor plate 20. It may be noted that the receptor plate 20 is thus firmly and rigidly secured to the column 12 and will transmit any and all forces received by it directly to the column 12.

Each of the plates 16 and 20 have interlocking cross-sectional configurations with respect to each other to form a keyed interlocking structure. A layer of elastomeric material 28 is positioned between and in contact with the plates 16 and 20 to dynamically maintain the plates separated. Thus, seismic motions transmitted from the foundation 10 are dampened and dissipated by the elastomeric layer prior to transmission to the column 12. Similarly, wind vortex, impact, or imbalanced machine forces are dampened and dissipated in the layer 28 prior to the transmission from the column 12 to the foundation 10.

It is important to note that the vibration and shock isolation bearing system 14 not only provides the function of vibratory or impact dynamic motion dampening, but also provides a shear proof and uplift proof coupling between the foundation 10 and the column 12. That is, unlike the multi-layered flat plate structures in the prior art, no structural connection need be made between the major structural elements of the building such as the column 12 and the foundation 10 other than the vibration and shock isolation bearing of the present invention. During the occurrence of a shock (seismic for example) the two structural parts 10 and 12 develop a limited local displacement controlled by the size and geometry of the elastomeric layer 28. Similarly, during vibration this limited displacement reduces the force being transmitted from one structural part to the other. A continuous vibration resulting from such things as unbalanced mechanical machinery is isolated from one major structural component to the other by the elastomeric layer which isolates the transmitted motion and absorbs energy creating heat in the layer 28. In the event of the occurrence of excessive amplitudes of the shock or vibration, the interlocking cross-sectional configuration of the plates 16 and 20 prevent structural failure of the joint and transfers the excessive forces to ductile structural parts of the building structure.

It may be noted that the embodiment chosen for illustration in FIG. 1 incorporates plates 16 and 20 having interlocking cross-sectional configurations forming longitudinally extending keys. These keys prevent shear force failure resulting from shear forces in the direction of the arrows 30 and 31; prevention of shear failure may be provided in the direction of the arrows 32 and 33 by incorporating an end plate such as that shown at 35 and a similar plate (not shown) at an opposing end of the donor plate 16. Similarly, omnidirectional shear proofing may be achieved by incorporating an interlocking cross-sectional configuration incorporating different types of shear key patterns. Such patterns as those shown in FIGS. 9*a* through 9*f* would provide protection against shear failure in multiple directions.

Figure 9A:
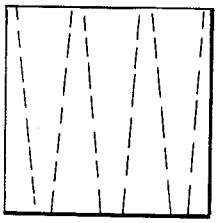
FIGS. 9*a* through 9*f* are schematic representations of alternate types of shear key patterns for use in the vibration and shock isolation system of the present invention.
Figure 9B:
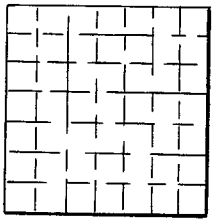
Figure 9C:
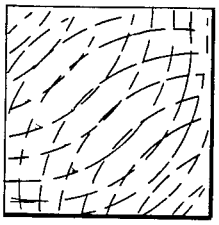
Figure 9D:
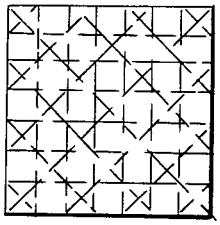
Figure 9E:
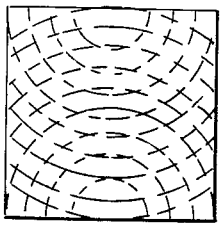
Figure 9F:
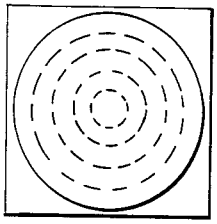

FIG. 9*a* illustrates the utilization of interlocked donor and receptor plates wherein the keyways are tapered in the plan view; similarly, the interlocking plates of FIGS. 9*c*, 9*e* and 9*f* represent arcuate, semicircular, or circular keyways wherein the receptor and donor plates are first keyed to an interlocking position with respect to each other by rotating one with respect to the other. With regard to FIG. 9*f*, the circular interlocking keyways would first have to be formed using semicircular keyways in a manner similar to that in FIG. 9*e*. The circular configuration of the keys and keyways in FIG. 9*f* would thus be achieved by using semi-circular donor and receptor plates that are keyed and rotated with respect to each other to interlock same and then using a duplicate pair of receptor and donor plates and welding the two halves of the interlocked plates together to form the configuration shown in FIG. 9*f*. The keying configurations of FIGS. 9*b* and 9*d* are multi-layer configurations; that is, the donor and receptor plates in FIG. 9*b* may be the same as that shown with respect to FIG. 1 with the addition of a second layer of donor and receptor plates with the keyways orthogonally related to the keyways of the first donor and receptor plates. Similarly, the configuration of 9*d* utilizes a multi-layered structure including keyways orthogonally related as well as angled at a 45° angle with respect to each other.

FIG. 2 represents an alternative keying pattern that may be utilized for the donor and receptor plates. It is noted that although the cross-sectional configuration of the plates is different from that shown in FIG. 1, the plates nevertheless have interlocking cross-sectional configurations with respect to each other to form a keyed shear and uplift proof bearing structure. Similarly, the alternative cross-sectional configuration shown in FIG. 3 provides the same keyed structure but uses non-symmetrical keys and keyways to provide the interlocking relationship between the plates. That is, plate 40 is provided with "L"-shaped keys 41 that extend into corresponding keyways 43 provided in the plate 45. Similar keys and keyways are provided in the plate 45 and 40 respectively. The plates 40 and 45 may be identical as shown in FIG. 3 or may vary with respect to each other; for example, the plate may be different thickness. The space between the plates is filled with a layer 46 of elastomeric material in the manner described previously in connection with the embodiment of FIG. 1. Although the keys and keyways of FIG. 3 are nonsymmetrical, the form of the plates still provide an interlocking relationship with respect to each other to provide a shear and uplift proof structure.

The ability of the aseismic bearing of the present invention to provide bearing failure due to displacement and to prevent failure resulting from uplift forces is important. The total displacement permitted by the bearing is limited to the space occupied by the elastomeric layer; in the event the forces on the bearing exceed the ability of the elastomeric layer to withstand the force, the elastomeric layer may be destroyed but the displacement in the shear direction or in the uplift direction is strictly limited by the interlocking of the plates. In this manner, anticipated vibratory or shock loading may be accommodated by the size and specific shape of the elastomeric layer; however, extremely severe shocks (those beyond the anticipated shock values) will not destroy the integrity of the structural joint incorporating the bearing.

The embodiment shown in FIG. 4 incorporates a donor plate 50 as well as a receptor plate 51. The donor and receptor plates are interlocked with respect to each other through the utilization of an interceptor plate 52 which is positioned between the donor and receptor plates and is keyed to provide an interlocking relationship among all three plates. The elastomeric layer may take the form of two separate layers 55 and 56 positioned between the interceptor plate 52 and the receptor plate as well as between the interceptor plate and the donor plate respectively. The utilization of an interceptor plate such as that shown in FIG. 4 may provide the means whereby an increased displacement may be accommodated in response to dynamic forces without increasing the specific thickness of an individual elastomeric layer.

The present invention also incorporates the distribution of shock and vibration bearings at strategic locations throughout the building superstructure. For example, FIGS. 5, 6, 7, 8 and 10 each show the utilization of a bearing constructed in accordance with the teachings of the present invention at various junctures of structural elements typically found in building superstructures. In each instance, the structural elements are connected through plates having interlocking cross-sectional configurations such that the structural elements are connected to each other only through the vibration and shock absorbing elastomeric layer. In each instance, it is important to note that the structural integrity of the joint between the structural elements is assured since the interlocking relationship of the plates presents separation of the plates even if, for any reason, the intervening elastomeric layer is destroyed. Further, each of the vibration and shock isolation couplings between the structural elements may take the form of interlocking cross-sectional configurations forming a keyed structure such as that shown in FIG. 1, or may take any of the alternative keyed configurations such as those shown in FIGS. 2 and 3. The shock and vibration isolating characteristics of joints between major structural components of a building will provide significant isolation to major seismic shocks and will assist in the distribution of seismic loads imposed on the structure. It is important that the aseismic joints provide complete elastomeric isolation between the joined parts while the requirement of structural integrity is of equal importance. That is, each joint must be capable of providing joint integrity even if the elastomeric layer is destroyed. The importance of the "keying" thus becomes apparent when it is recognized that structural integrity of the joint must be guaranteed without sacrificing the vibration and shock isolation characteristics of the elastomeric layer.

Figure 11:
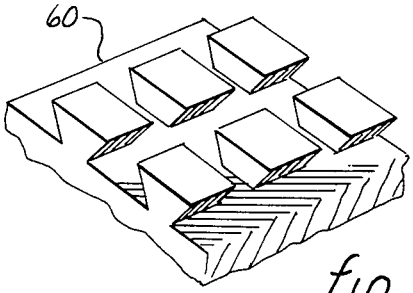
FIG. 11 is an isometric illustration of an alternate form of interlocking plate that may be used in the concept of the present invention and one which may be useful to decrease the stiffness of the elastomeric layer.

The stiffness of any particular elastomeric layer may be chosen in accordance with the particular loads that a specific design is intended to encounter. The stiffness may be altered in various ways such as by the utilization of interrupted keys such as shown in FIG. 11 wherein it may be seen that an elastomeric layer placed in the interstices between the keys of the plate 60 (and a keyed interlocking plate—not shown) may bulge into the interstices between the adjacent keys to thus provide a less stiff aseismic joint.

Figure 6:
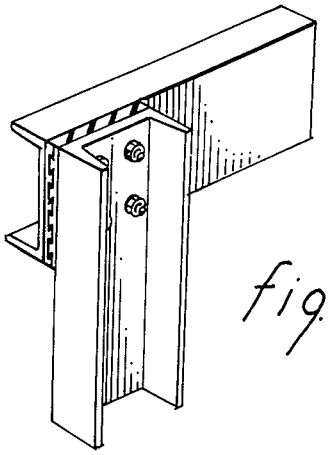
FIG. 6 is an isometric view showing a vibration and shock isolation element positioned between elements of the superstructure of a building.
Figure 7:
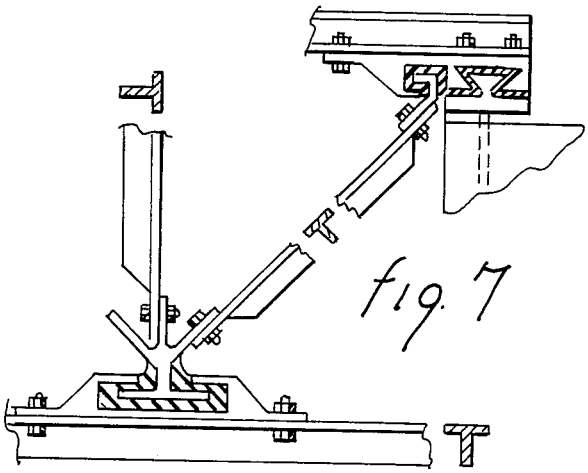
FIG. 7 is an illustration of the utilization of a vibration and shock isolation device constructed in accordance with the teachings of the present invention used in a truss structure.
Figure 8:
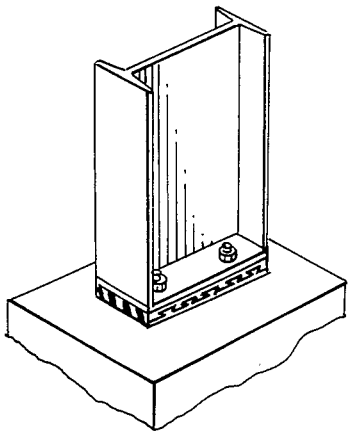
FIG. 8 is an isometric view of the use of a vibration and shock isolation element constructed in accordance with the teachings of the present invention positioned between a column and a supporting base.

The utilization of vibration and shock isolation throughout the building structure provides a significant improvement in the ability of the structure to withstand such loads. The incorporation of such bearings in Spandrell joints such as shown in FIG. 5 or subframing joints such as shown in FIG. 6 provide a predetermined design flexibility to the entire superstructure of the building. Similarly, column and base junctures such as shown in FIG. 8 or plane truss joints as shown in FIG. 7 incorporated in the building structure provide flexibility without sacrificing structural integrity. Similarly, the space truss structure shown in FIG. 10 provides similar advantages in the overall building structure. Thus, the individual joints are provided with an elastomeric vibration and shock isolation and can also provide vibratory energy dissipation. The interlocking nature of the respective joints provides a shear, uplift, torsion, and moment proof connection between respective building components; that is, the forces transmitted through the joint, regardless of the nature of the force, will not cause the loss of integrity of the joint.

It may also be noted that an aseismic bearing may be formed in accordance with the teachings of the present invention without the specific utilization of a separate donor and receptor plate. That is, it is possible in certain environments, to form interlocking keys in supporting and supported components of the building without separate plates. For example, the utilization of appropriate concrete forms can be used to form interlocking keys between a column and a base provided however that an elastomeric layer be appropriately positioned between the two and provided also that appropriate reinforcing be added to the concrete to provide the appropriate strength necessary to accommodate design moment or uplift forces. It will be apparent to those skilled in the art that the donor and receptor plates need not be made of steel or metal and can be made of other materials; however, in most applications metal plates will provide the necessary strength accompanied by convenient characteristics.

I claim:

1. In a building structure having major structural elements to be secured to each other, a vibration and shock isolation and energy absorption system comprising:

(a) a donor plate secured to a first structural element;
(b) a receptor plate secured to a second structural element;
(c) an interceptor plate positioned between said donor and receptor plates;
(d) a first layer of elastomeric material positioned between and in contact with said donor and said interceptor plates to maintain said plates separated;
(e) a second layer of elastomeric material positioned between and in contact with said interceptor and receptor plates to maintain said plates separated;
(f) said donor and interceptor plates having keyed interlocking cross-sectional configurations with respect to each other securing said interceptor and donor plates together;
(g) said interceptor and receptor plates having keyed interlocking cross-sectional configurations with respect to each other securing said interceptor and receptor plates together;

(h) said plates forming a keyed interlocking intermediate element between said structural elements;

whereby, said isolation and absorption is achieved exclusively by said elastomeric layers.

2. In a building structure having a foundation and having major structural elements secured to said foundation, a vibration and shock isolation and energy absorption system comprising:

(a) a donor plate secured to said foundation;

(b) a receptor plate secured to a major structural element;

(c) a layer of elastomeric material positioned between and in contact with said donor and receptor plates to maintain said plates separated; and (d) said plates having keyed interlocking cross-sectional configurations with respect to each other securing said plates together to form a keyed interlocking shear and uplift proof intermediate element between said foundation and said structural element;

whereby, said isolation and absorption is achieved exclusively by said elastomeric layer.

3. In a building structure having a foundation and having a plurality of major structural elements, a vibration and shock isolation and energy absorption system comprising:

(a) a donor plate secured to said foundation;

(b) a receptor plate secured to a major structural element;

(c) a layer of elastomeric material positioned between and in contact with said donor and receptor plates to maintain said plates separated;

(d) said plates having keyed interlocking cross-sectional configurations with respect to each other securing said plates together to form a keyed interlocking shear and uplift proof intermediate element between said foundation and said structural element; and (e) a plurality of vibration and shear isolation and energy absorption devices each positioned at a junction between predetermined ones of said major structural elements, each of said devices having;

i. a donor plate secured to a first structural element;

ii. a receptor plate secured to a second structural element;

iii. a layer of elastomeric material positioned between and in contact with said donor and receptor plates to maintain said plates separated;

iv. said plates having keyed interlocking cross-sectional configurations with respect to each other securing said plates together to form a keyed interlocking intermediate element between said structural element;

whereby, said isolation and absorption is achieved exclusively by said elastomeric layers.

4. The combination set forth in claims 1 2 or 3 wherein said donor and receptor plates are each formed integrally with the structural elements or foundation.

* * * * *